US006847171B2

(12) United States Patent
Tam

(10) Patent No.: US 6,847,171 B2
(45) Date of Patent: Jan. 25, 2005

(54) ORGANIC ELECTROLUMINESCENT DEVICE COMPENSATED PIXEL DRIVER CIRCUIT

(75) Inventor: Simon Tam, Cambridge (GB)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/023,652

(22) Filed: Dec. 21, 2001

(65) Prior Publication Data

US 2003/0117082 A1 Jun. 26, 2003

(51) Int. Cl.[7] ..... G09G 3/10

(52) U.S. Cl. ..... 315/169.3; 315/169.1; 345/84

(58) Field of Search ..... 315/169.1, 169.3, 315/169.4; 345/76–84, 90, 92

(56) References Cited

U.S. PATENT DOCUMENTS 5,519,288 A * 5/1996 Tatsumi et al. ..... 315/169.3
5,684,368 A * 11/1997 Wei et al. ..... 315/302
5,714,968 A 2/1998 Ikeda ..... 345/77
6,229,506 B1 * 5/2001 Dawson et al. ..... 345/82
6,351,078 B1 * 2/2002 Wang et al. ..... 315/169.3
6,501,449 B1 * 12/2002 Huang ..... 345/82
6,501,466 B1 * 12/2002 Yamagishi et al. ..... 345/204

FOREIGN PATENT DOCUMENTS

EP 0 365 445 A2 4/1990
GB 2 337 354 A 11/1999

* cited by examiner

*Primary Examiner*—Don Wong
*Assistant Examiner*—Ephrem Alemu
(74) *Attorney, Agent, or Firm*—Oliff & Berridge, PLC

(57) ABSTRACT

A compensated pixel driver circuit for an organic electroluminescent device, wherein the circuit comprises a unity gain buffer which is preferably implemented as an operational amplifier. The circuit provides a unity gain sample and hold function, thereby compensating the current supply to the electroluminescent element by providing a self adjusting load.

18 Claims, 10 Drawing Sheets

| | |
|---|---|
| Open-Loop Gain (OLG) | >20 |
| $V_{DD}$ | 9V |
| $V_{55}$ | 0V |
| $V_{DLT}$ | 1 V - 8 V |
| Inverting Input (V) | = $V_{OUT}$ |
| Non-Inverting Input (V) | 1 V - 8 V |
| Max Output Current | 1μA |
| Settle Time | <20μs |
| Offset Voltage | Minimal |
| Quiescent Current | Minimal |
| Space Occupation | < 210x70μm² |

SINGLE POWER SUPPLY RAIL TO RAIL

ORGANIC ELECTROLUMINESCENT DEVICE COMPENSATED PIXEL DRIVER CIRCUIT

BACKGROUND OF THE INVENTION

1. Field of the Invention

The present invention relates to an organic electroluminescent device and particularly to a compensated pixel driver circuit thereof.

2. Description of Related Art

An organic electro-luminescent device (OELD) consists of a light emitting polymer (LEP) layer sandwiched between an anode layer and a cathode layer. Electrically, this device operates like a diode. Optically, it emits light when forward biased and the intensity of the emission increases with the forward bias current. It is possible to construct a display panel wide a matrix of OELDs fabricated on a transparent substrate and with one of the electrode layers being transparent. One can also integrate the driving circuit on the same panel by using low temperature polysilicon thin film transistor (TFT) technology.

In a basic analog driving scheme for an active mat OELD display, a minimum of two transistors are required per pixel (FIG. 1): $T_1$ is for addressing the pixel and $T_2$ is for converting the data voltage signal into current which drives the OELD at a designated brightness. The data signal is stored by the storage capacitor $C_{storage}$ when the pixel is not addressed. Although p-channel TFTs are shown in the figures, the same principle can also be applied for a circuit with n-channel TFTs.

There are problems associated with TFT analog circuits and OELDs do not act like perfect diodes. The LEP material does, however, have relatively uniform characteristics. Due to the nature of the TFT fabrication technique, spatial variation of the TFT characteristics exists over the entire panel. One of the most important considerations in a TFT analog circuit is the variation of threshold voltage, $\Delta V_T$, from device to device. The effect of such variation in an OELD display, exacerbated by the non perfect diode behaviour, is the non-uniform pixel brightness over the display panel, which seriously affects the image quality. Therefore, a built-in compensation circuit is required.

A simple threshold voltage variation compensation, current driven, circuit has been proposed. The current driven circuit, also known as the current programmed threshold voltage compensation circuit is illustrated in FIG. 2A. In this circuit, $T_1$ is for addressing the pixel. $T_2$ operates as an analog current control to provide the driving current. $T_3$ connects between the drain and gate of $T_2$ and toggles $T_2$ to be either a diode or in saturation. $T_4$ acts a switch. Either $T_1$ or $T_4$ can be ON at any one time. Initially, $T_1$ and $T_3$ are OFF, and $T_4$ is ON. When $T_4$ is OFF, $T_1$ and $T_3$ are ON, and a current of known value is allowed to flow into the OLED, through $T_2$. This is the programming stage because the threshold voltage of $T_2$ is measured with $T_2$ operating as a diode (with $T_3$ turned ON) while the programming current is allowed to flow through $T_1$, through $T_2$ and into the OELD. $T_3$ shorts the drain and gate of $T_2$ and turns $T_2$ in to a diode. The detected threshold voltage of $T_2$ is stored by the capacitor $C_1$ connected between the gate and source terminals of $T_2$ when $T_3$ and $T_1$ are switched OFF. Then $T_4$ is turned ON, the current is now provided by $V_{DD}$. If the slope of the output characteristics were flat, the reproduced current would be the same as the programmed current for any threshold voltage of $T_2$ detected. By turning ON $T_4$, the drain-source voltage of $T_2$ is pulled up, so a flat output characteristic will keep the reproduced current the same as the programmed current. Note that $\Delta V_{T2}$ shown in FIG. 2A is imaginary, not real.

A constant currant is provided, in theory, during the active programming stage, which is $t_3$ to $t_4$ in the timing diagram shown in FIG. 2A. The reproduction stage starts at $t_6$ and ends at $t_1$ of the next cycle.

In practice, there is always a slope in the output characteristics, so the reproduced current is not the same as the programmed current. This issue limits the device channel length of the polysilicon TFTs because of the increase of the short channel effect in polysilicon TFTs when the device channel length gets smaller. Simulations show that the variation between the reproduced current and programmed current is unacceptable for L=4 $\mu$m and below. This limitation on the design of transistor $T_2$ is a very serious practical problem, especially when small data currents are used. It is therefore important to find a technique that will provide good compensation in short channel devices.

The driving waveforms used are shown in timing chart fashion in FIG. 2B. The threshold voltage $V_T$ shown at the bottom of FIG. 2B is that for transistor $T_2$. As can be seen from FIG. 2B, this threshold voltage has a range of −1V to +1V. Such a range is much larger than the variation $\Delta V_T$ across a practical OELD mate.

Typical variation between the reproduced current and programmed current supplied to the OELD is illustrated in FIG. 2C. FIG. 2C illustrates three cycles of OELD current supply: one from 0 to 30 $\mu$s, one from 30 $\mu$s to 60 $\mu$s, and one from 60 $\mu$s to 90 $\mu$s. The first half of each of these cycles is the programming stage and the second half of the cycle is the reproduction stage. It is to be noted that the current output levels in the reproduction stage compared with those in the corresponding program stage are remarkably different firm each other.

SUMMARY OF THE INVENTION

According to a first aspect of the present invention there is provided a compensated pixel driver circuit for an organic electroluminescent device, wherein the circuit comprises a unity gain buffer. Preferably the unity gain buffer is implemented as an operational amplifier.

According to a second aspect of the present invention there is provided a method of compensating the current supply to an organic electroluminescent pixel comprising. The step of using a unity gain buffer to provide a self adjusting load.

According to a third aspect of the present invention there is provided an organic electroluminescent display device comprising one or more compensated pixel driver circuits according to the first aspect of the invention.

BRIEF DESCRIPTION OF THE DRAWINGS

Embodiments of the present invention will now be described by way of example only and with reference to the accompanying drawings, in which.

DETAILED DESCRIPTION OF THE PREFERRED EMBODIMENTS

Figure 1:
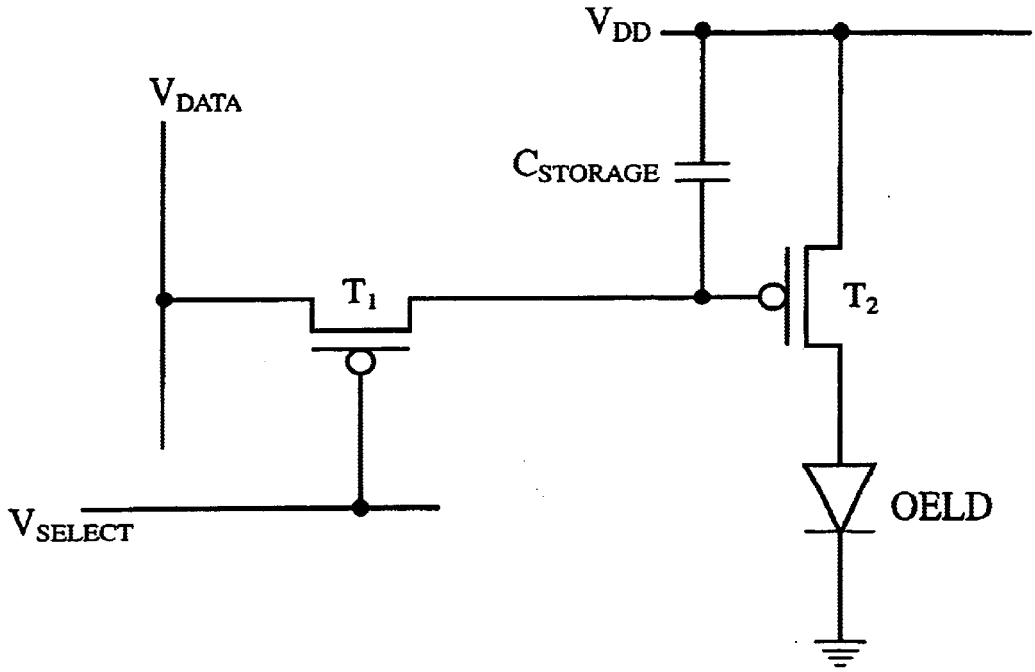
FIG. 1 shows a conventional OELD pixel driver circuit using two transistors.
Figure 2A:
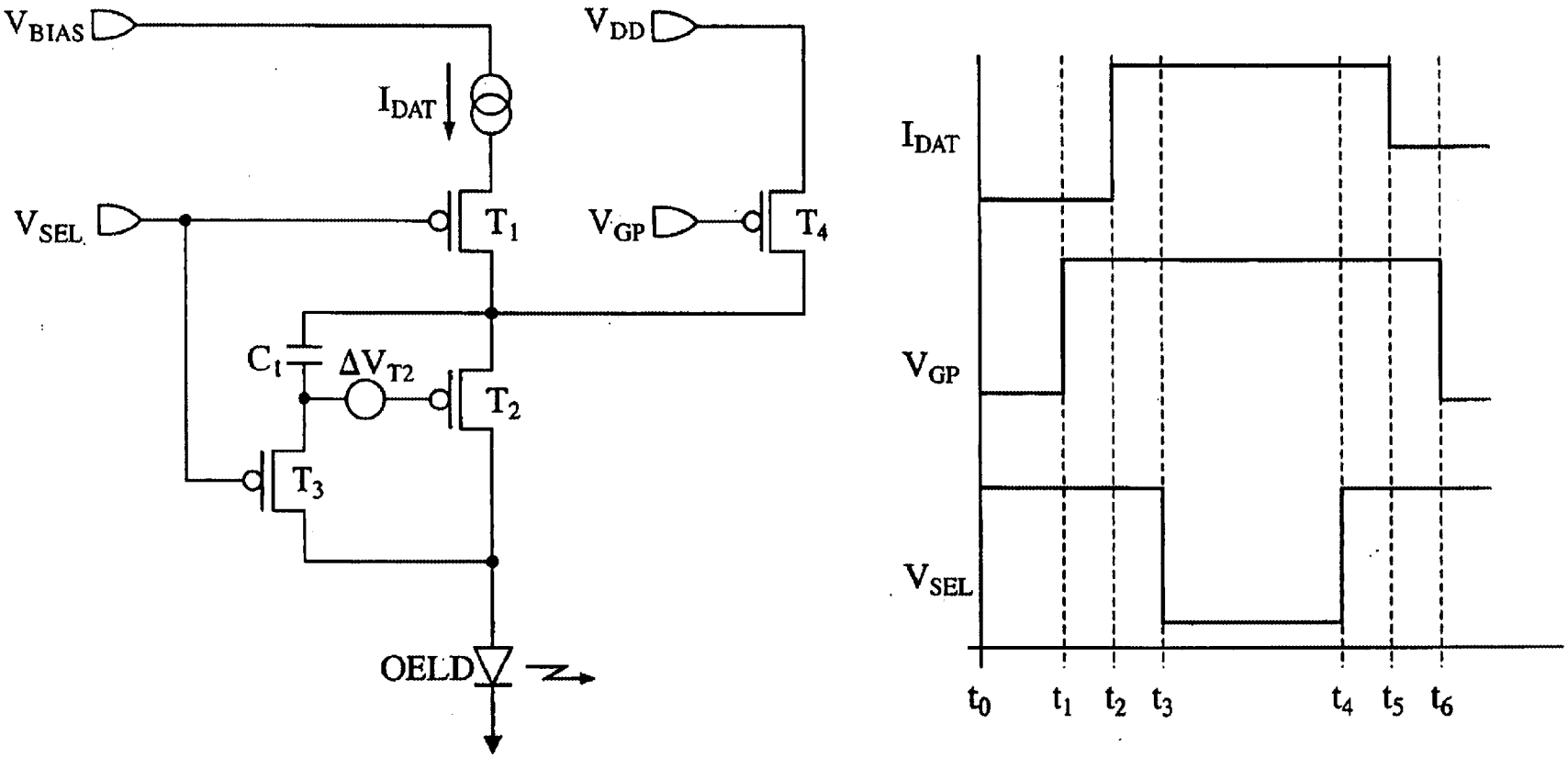
FIG. 2 shows a current programmed OELD driver with threshold voltage compensation.
Figure 2B:
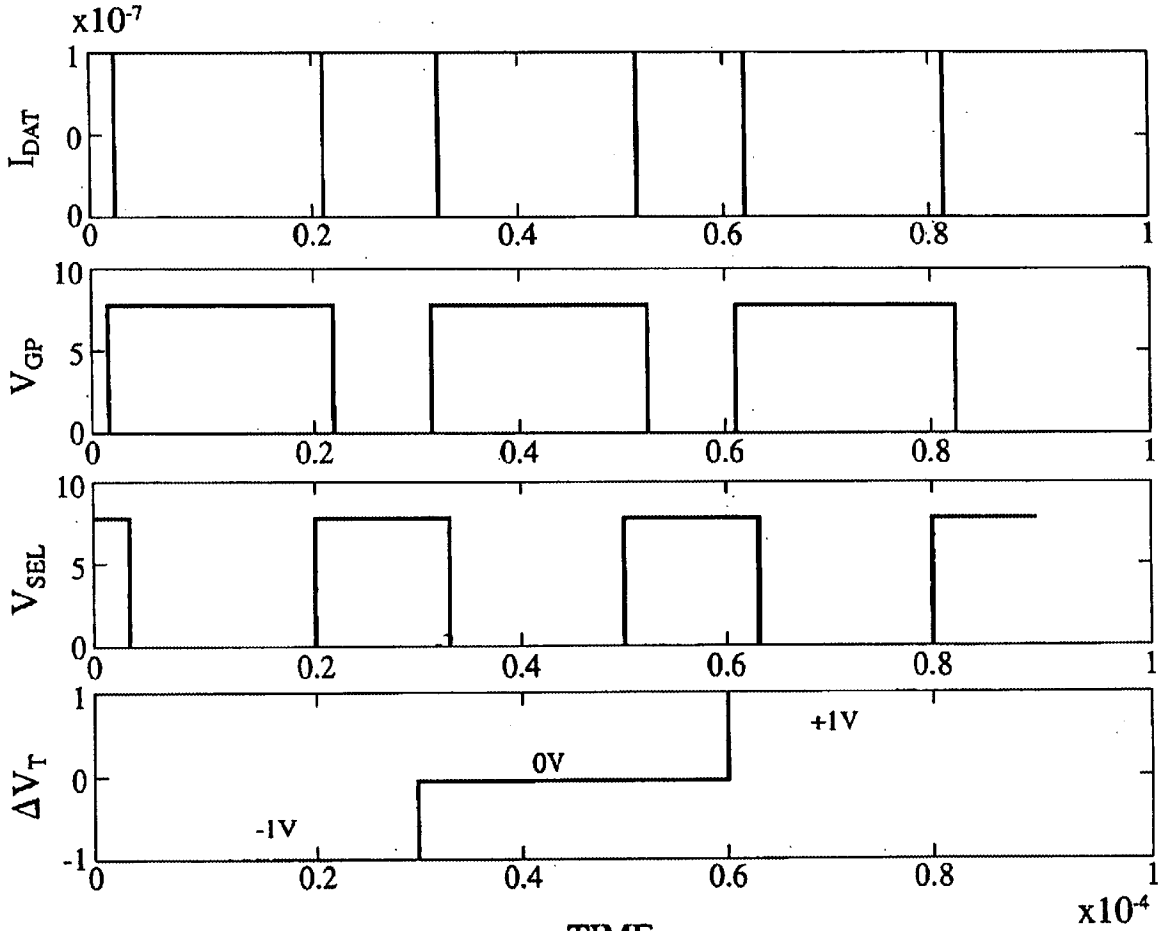
Figure 2C:
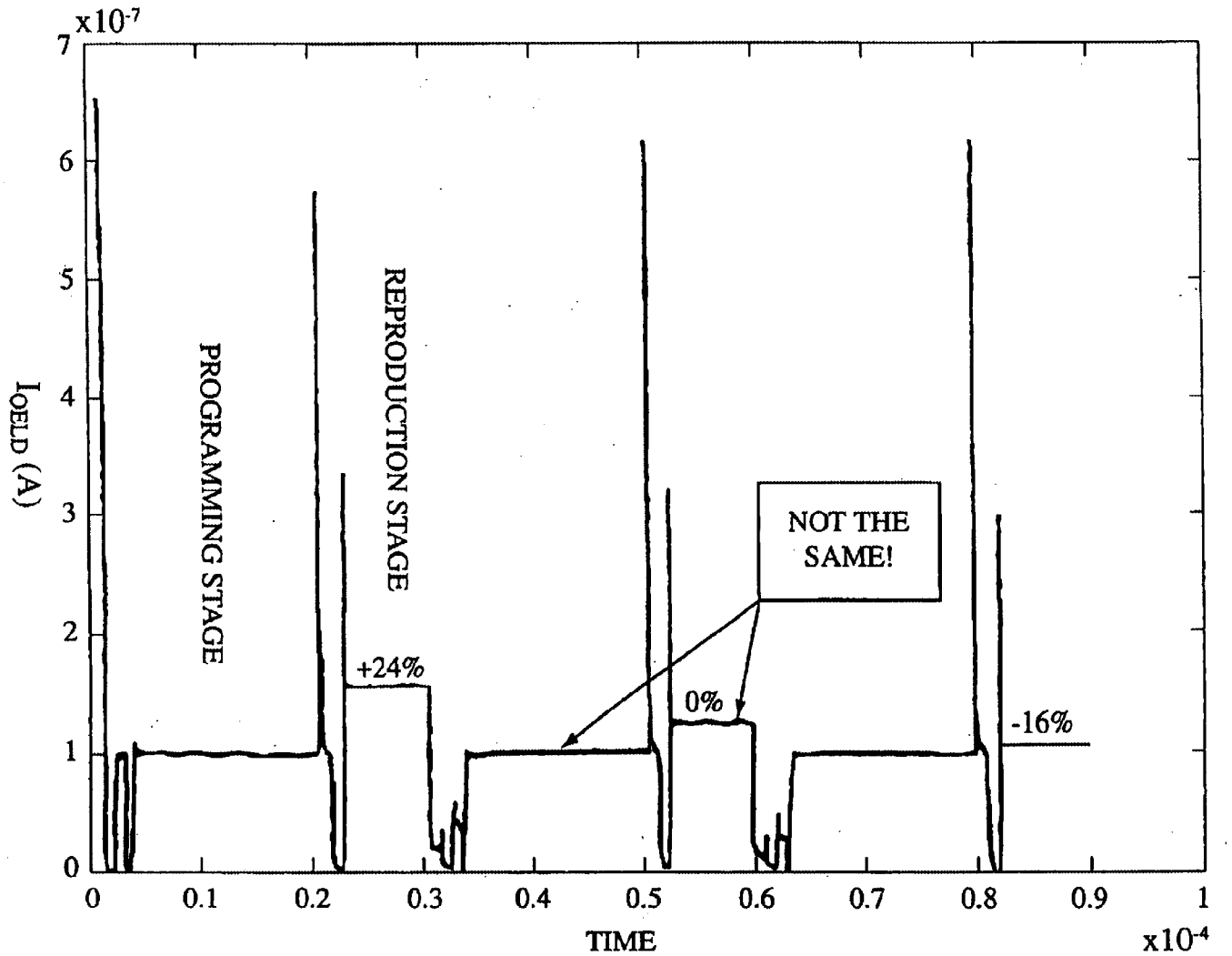
Figure 3:
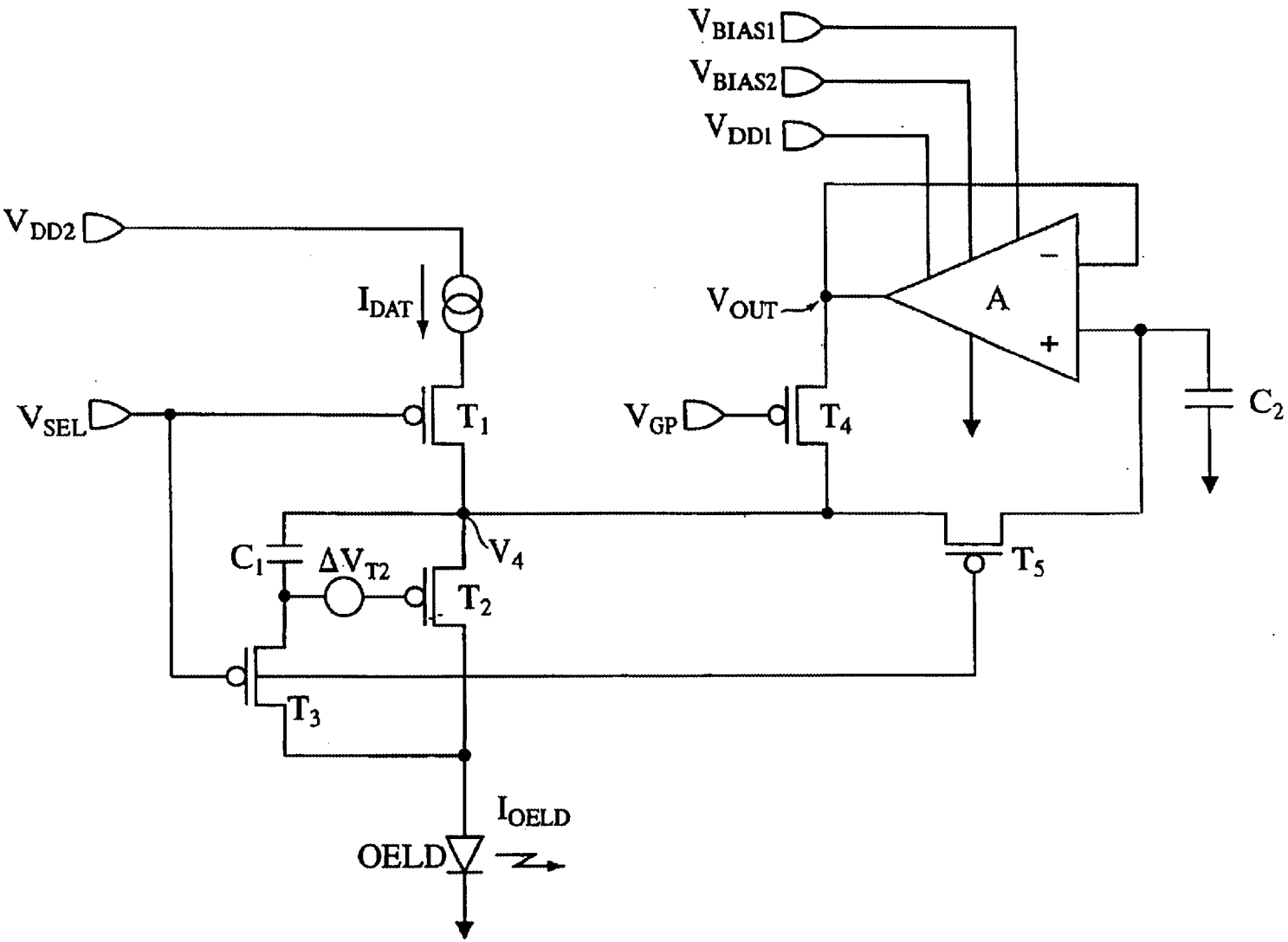
FIG. 3 shows a compensated pixel driver circuit according to an embodiment of the present invention.

A compensated pixel driver circuit according to an embodiment of the present invention is shown in FIG. 3. Compared with the circuit of FIG. 2, there is added an operational amplifier OpAmp A, a capacitor $C_2$ and a transistor $T_5$. As shown in FIG. 3, $V_{out}$ of the OpAmp is connected to the inverting input V_ thereof. The OpAmp thus has unity gain. Capacitor $C_2$ ensures a sample ad hold function and transistor $T_5$ acts as a control switch to store the voltage on $C_2$. In effect the circuit provides a self-adjusted load or voltage source ($V_{DD}$) and by thus holding the operative voltage constant the effect of the slope in the output characteristics can be avoided. In it's generic form, the OpAmp A is a unity gain buffer having it's input connected to the source-drain path of transistor $T_5$ and it's output connected to the source-drain path of transistor $T_4$, the input being connected to ground via capacitor $C_2$.

As shown in FIG. 3, a TFT operational amplifier configured as a sample and hold circuit is used to provide a variable voltage source so that the drain-source voltage of $T_2$ in the reproduction stage is the same as that during the programming stage. During the programming stage, the voltage at the source of $T_2$ is passed to the storage capacitor $C_2$ at the input of the unity-gain OpAmp. The output of the OpAmp faithfully reproduces the voltage and also provides the current to the OELD through $T_2$. The driving waveform is the same as that for the circuit of FIG. 2.

The program current path is from $V_{DD2}$ through node $V_4$, $T_1$, $T_2$ and the OELD. The reproduction current path is from $V_{DD1}$, through the OpAmp, $V_{out}$, $T_4$, node $V_4$, $T_2$ and the OELD.

In the circuit of FIG. 3, the voltage at point $V_4$ is substantially the same in the reproduction cycle to the voltage at that point in the programming cycle. Additionally, a very high Open-Loop Gain (OLG) is not required in contrast to usual TFT circuits. An advantage of the embodiment of the present invention shown in FIG. 3 is that the current flow to the OELD during the reproduction cycle is less sensitive to the variation in the output $V_{out}$ of the OpAmp than $\Delta V_{T2}$ detection of the same percentage error. Furthermore, the OpAmp design constraints are not stringent.

Figures 4, 5:
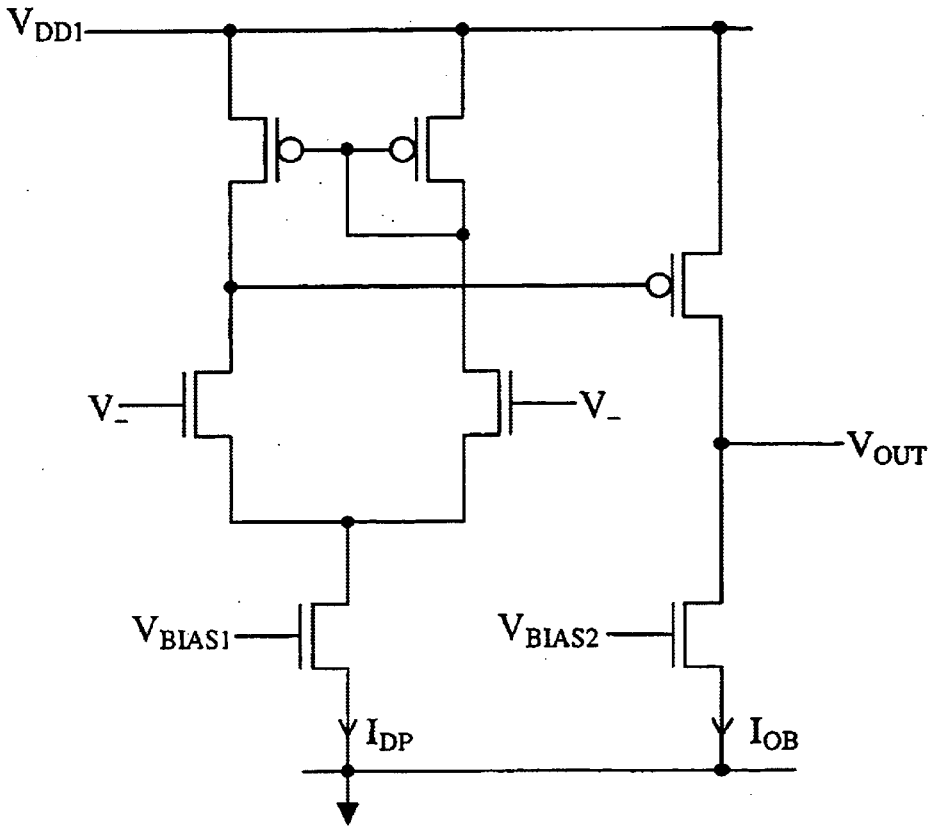
FIG. 4 is a table of requirements for one specific example of an operational amplifier which can be used in the circuit of FIG. 3.
FIG. 5 is an example of a circuit for implementing the operational amplifier shown in FIG. 3.

FIG. 5 is a circuit diagram of one arrangement for implementing the OpAmp shown in FIG. 3. The specific requirements for this circuit are shown in the table of FIG. 4. Of particular note is the minimal off-set voltage. Typically is might be a few millivolts, in contrast to the variation of several volts which may typically arise in the conventional arrangement due to the slope of the output characteristics. The circuit of FIG. 5 essentially consists of a differential pair circuit and a driver. The differential pair circuit comprises the toy two transistors connected to the $V_{DD1}$ rail, the respective transistors having their gates providing the two input terminals of the OpAmp, and the transistor whose gate receives $V_{bias1}$. The output driver comprises a transistor receiving $V_{bias2}$ at its gate and a transistor connected between the $V_{DD1}$ rail and $V_{out}$.

All of the transistors of the circuit of FIG. 5 are TFTs having a channel length of 10 $\mu$m (in contrast to $T_2$). This channel length avoids the devices being stressed by the high value of $V_{DD}$. The transistor connected between the $V_{DD1}$ rail and $V_{out}$ has a channel width of 100 $\mu$m in order to ensure sufficient current output. The area required to implement the circuit of FIG. 5 can be reduced by varying the W/L absolute size ratio of the transistors, subject to a corresponding reduction in the maximum drive current. The space occupation value of 270 $\mu$m×70 $\mu$m given in the table of FIG. 4 can, for example, be reduced to approximately 130 $\mu$m ×10 $\mu$m, subject to a reduction in the maximum drive current from 5 $\mu$A to 1.5 $\mu$A. However, in practice a maximum drive current of 1 $\mu$A might suffice (as indicated in FIG. 4).

In the specific example given, the current $I_{DP}$ flowing through the differential pair circuit has a maximum value of 1 $\mu$A and the current $I_{OB}$ flowing through the driver circuit has a maximum value of 5 $\mu$A. The additional current required by the presence of the OpAmp is thus minimal.

Figure 6:
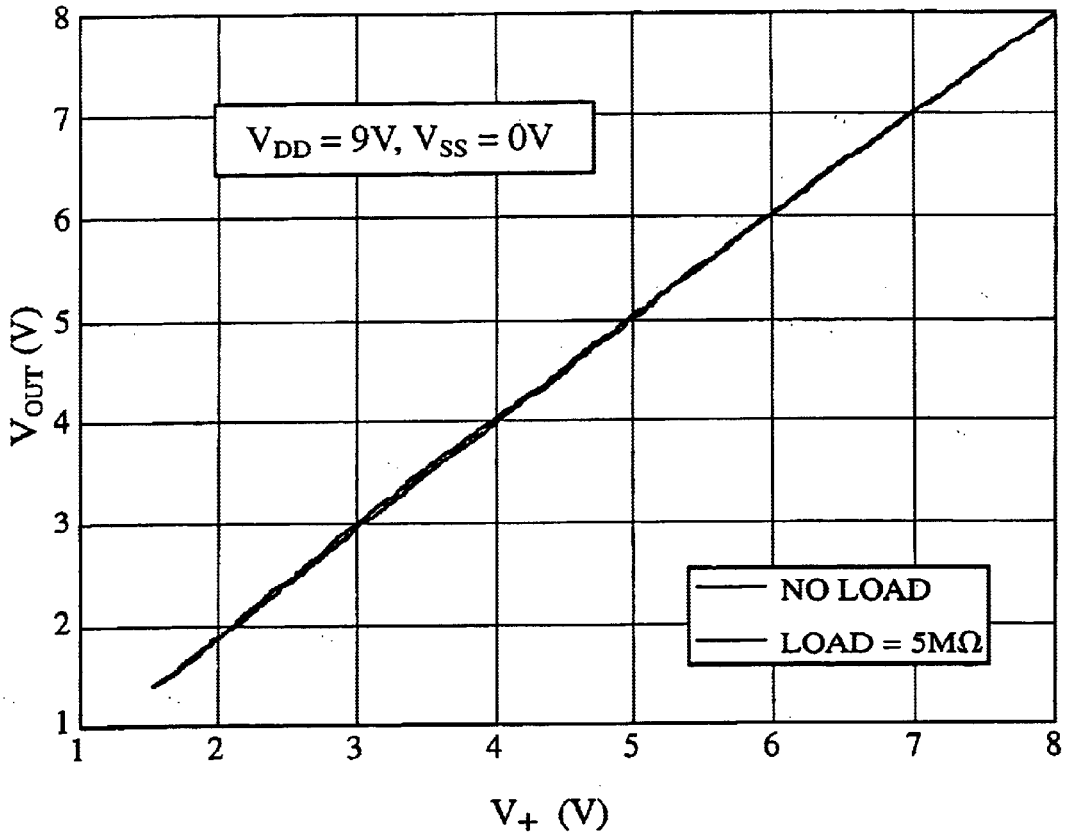
FIG. 6 is a graph illustrating the unity-gain buffer characteristics of the compensating circuit of FIG. 3.

FIG. 6 is a graph illustrating the unity-gain buffer characteristics of the compensating circuit of FIG. 3. As shown, the plot of $V_{out}$ against $V_+$ is the same for both the load and the no-load conditions. The load condition is 5 MΩ, which corresponds to a current of 1 $\mu$A through the OELD.

Figure 7:
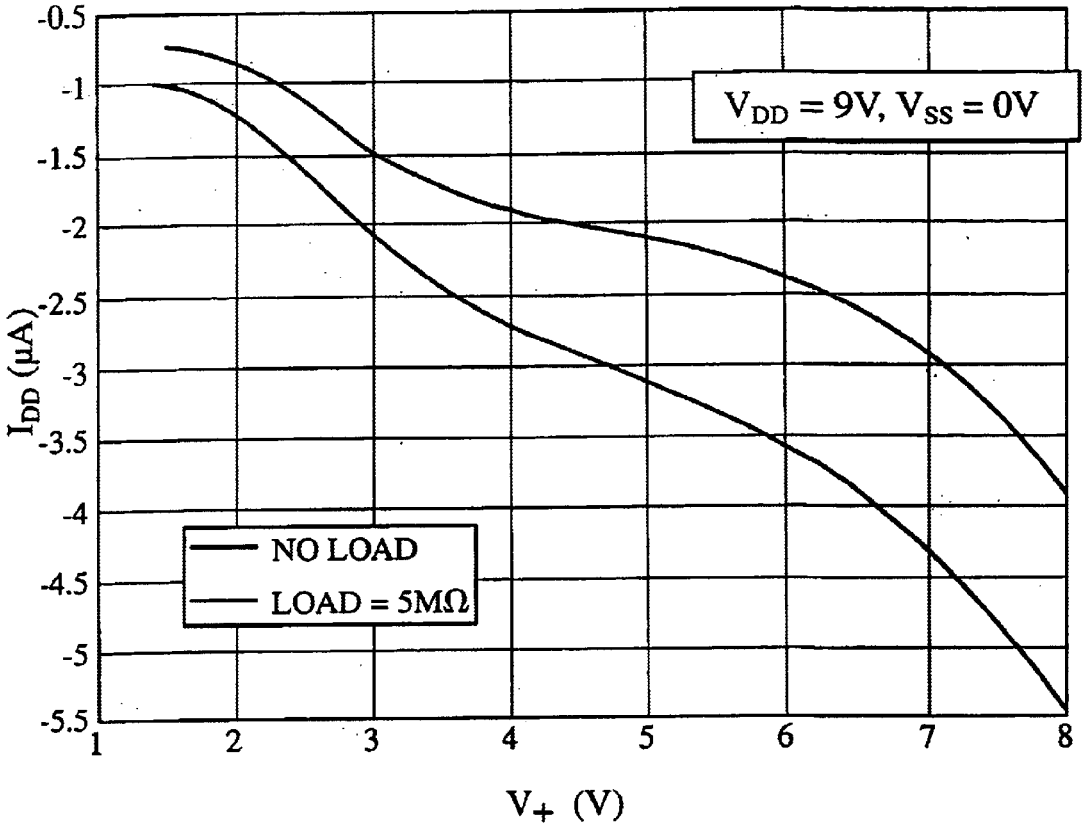
FIG. 7 is a graph illustrating the total required supply current.

The total current supply required by the OpAmp of FIG. 3, in one specific example, is shown in FIG. 7. The total current supply required is that required by the differential pair circuit (FIG. 5), that required by the OpAmp driver circuit (FIG. 5) and that required to drive the OELD. Again load (5 MΩ) and no-load conditions are shown.

Figure 8:
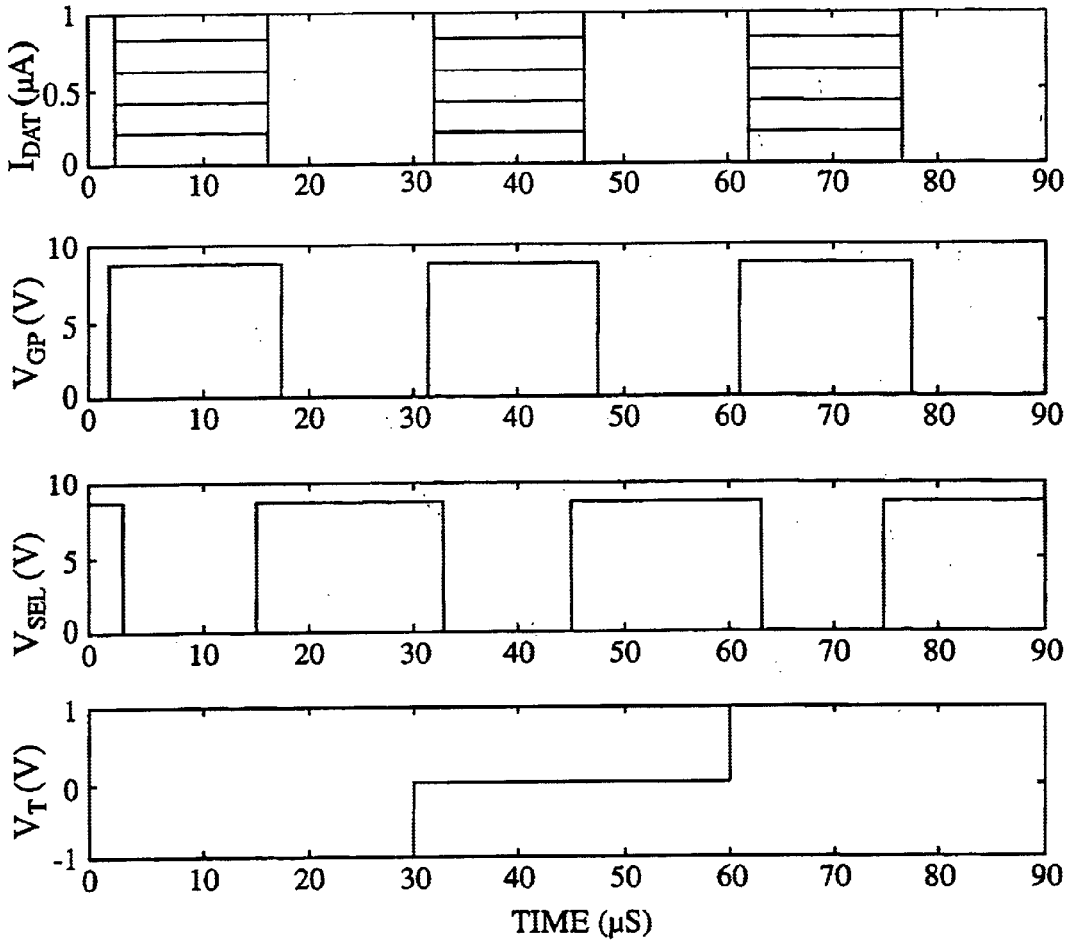
FIG. 8 is a driving waveform timing diagram.

The driving waveforms used with one implementation of the circuit of FIG. 3 are shown in timing chart fashion in FIG. 8. Of course, the threshold voltage $V_T$ shown at the bottom of FIG. 8 is that for transistor $T_2$. As can be seen from FIG. 8, this threshold voltage has a range of −1V to +1V. Such a range is much larger than the variation $\Delta V_T$ across a practical OELD matrix. Threshold variation $\Delta V_T$ in other transistors ($T_1$, $T_3$, $T_4$, $T_5$) have little effect as they are used as switches and operate under voltage ranges greater than $\Delta V_T$.

Figure 9:
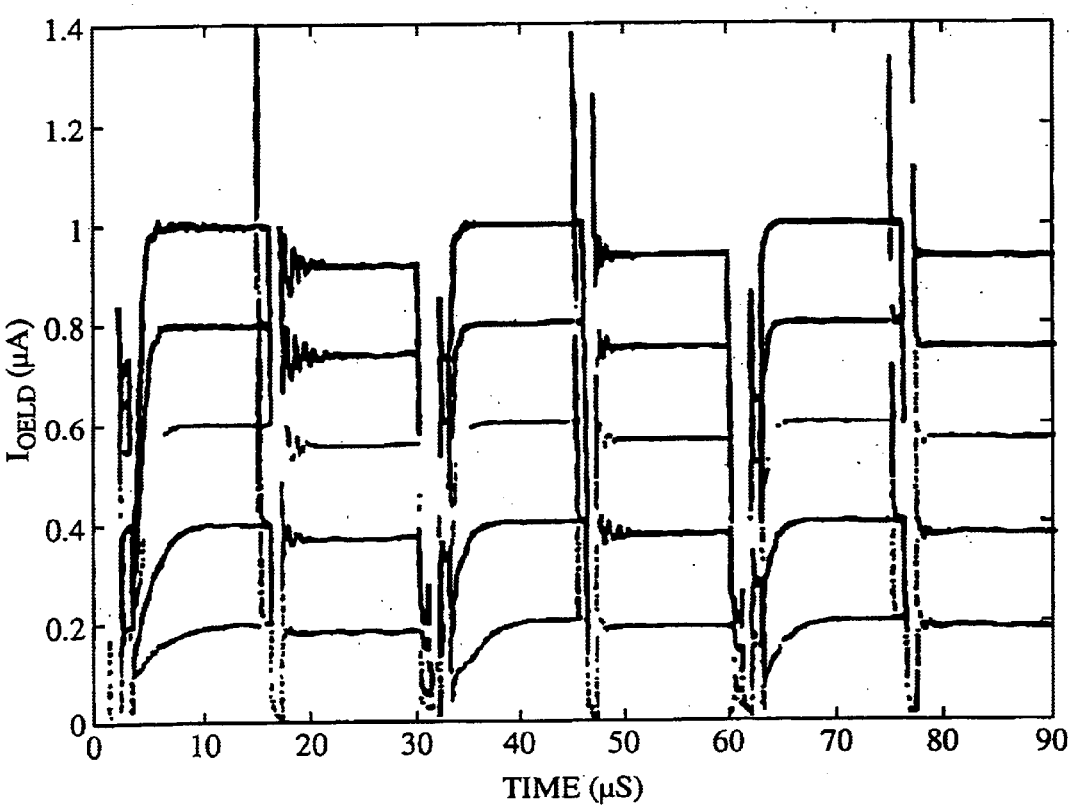
FIG. 9 illustrates the current output to the OELD using the circuit of FIG. 3.

The output current supplied to the OELD using the circuit of FIG. 3 is illustrated in FIG. 9. FIG. 9 illustrates three cycles of OELD current supply one from 0 to 30 $\mu$s, one from 30 $\mu$s to 60 $\mu$s, and one from 60 $\mu$s to 90 $\mu$s. The first half of each of these cycles is, of course, the program stage and the second half of the cycle is the reproduction stage. In each cycle, five different program currents are illustrated (ie vertically—at 0.2, 0.4, 0.6, 0.8 and 1.0). It is to be noted that the current output levels in the reproduction stage compared with those in the corresponding program stage are remarkably close. The comparison is slightly less good for larger program currents, but is still relatively small. Moreover, the difference can be predicted (as shown in FIG. 9) and can therefore be included in a gamma compensation (eg use 1.1 $\mu$A instead of 1 $\mu$A in the programming stage).

It will be apparent to persons skilled in the art that variations and modifications can be made to the arrangements described with respect to FIGS. 3 to 9 without departing from the scope of the invention.

What is claimed is:

1. A pixel driver circuit for a device like a diode, comprising:

a first storage capacitor;

a first transistor of which a gate is connected to the storage capacitor; and a unity gain buffer; and an input of the unity gain buffer being a voltage at one of a source and a drain of the transistor during a programming stage, wherein the unity gain buffer reproduces the voltage during a reproduction stage.

2. A pixel driver circuit as claimed in claim 1, wherein the unity gain buffer is implemented as an operational amplifier.

3. A pixel driver circuit as claimed in claim 1, wherein the buffer is connected to have unity gain.

4. A pixel driver circuit as claimed in claim 2, further comprising a second transistor so as to act as a current switch for storing voltage on a second capacitor.

5. A pixel driver circuit as claimed in claim 1, wherein the buffer comprises a differential pair circuit and a driver circuit.

6. A pixel driver circuit as claimed in claim 5, wherein the differential pair circuit comprises two transistors whose gates respectively provide an inverting input and a non-inverting input of the buffer and a further transistor whose gate provides a bias voltage input of the buffer.

7. A pixel driver circuit as claimed in claim 5, wherein the driver circuit comprises two transistors connected in series with the output of the buffer being taken from the said connection between these transistors.

8. A pixel driver circuit as claimed in claim 1, wherein the circuit is implemented with polysilicon thin film transistors.

9. A method of compensating a current supply to a pixel, the method comprising:

storing a voltage at one of a source and drain of a transistor during a programming stage by a unity gain buffer; and reproducing the voltage using the unity gain buffer.

10. An organic electroluminescent display device comprising one or more pixel driver circuits as claimed in claim 1.

11. A pixel driving circuit for a device like a diode, comprising:

a storage capacitor;

a transistor having a gate connected to the storage capacitor, the transistor operating as a current control; and a unity gain buffer, an input of the unity gain buffer being a voltage at one of a source and a drain of the transistor during a programming stage during which a current for programming is supplied as data to the pixel driver circuit, and the unity gain buffer reproducing the voltage during a reproduction stage during which a current corresponding to the current for programming is supplied through the transistor.

12. A pixel driver circuit, comprising:

a storage capacitor;

a pixel element;

a transistor having a gate connected to the storage capacitor, the transistor operating as a current control; and a unity gain buffer, an input of the unity gain buffer being a voltage at one of a source and a drain of the transistor during a programming stage daring which a data current for programming is supplied to the pixel driver circuit, and the unity gain buffer reproducing the voltage during a reproduction stage during which a current corresponding to the data current is supplied through the transistor to the pixel element.

13. A pixel driver circuit, comprising:

a storage capacitor;

an organic electroluminescent element;

a transistor having a gate connected to the storage capacitor, the transistor operating as a current control; and a unity gain buffer, an input of the unity gain buffer being a voltage at one of a source and a drain of the transistor during a programming stage during which a data current for programming is supplied to the pixel driver circuit, and the unity gain buffer reproducing the voltage during a reproduction stage during which a current corresponding to the data current is supplied through the transistor to the organic electroluminescent element.

14. A driving method for a display device that includes a pixel driving circuit having a pixel element, the method comprising:

a programming stage during which a data current for programming is supplied to the pixel driver circuit; and a reproduction stage during which a current corresponding to the data current is supplied to the pixel element;

wherein the method further comprises providing a unity gain buffer having an input and an output, and during the programming stage, supplying to the input of the unity gain buffer a voltage at one of a source and drain of a transistor that controls a current supplied to the pixel element, and during the reproduction stage, reproducing at the output of the unity gain buffer the voltage of one of the source and drain of the transistor.

15. The driving method according to claim 14, comprising the step of selecting the pixel element being an organic electroluminescent element.

16. A driving method for a display device that includes a pixel driving circuit having a pixel element, the method comprising:

a programming stage during which a data current for programming is supplied to the pixel driver circuit; and a reproduction stage during which a reproduction current corresponding to the data current is supplied to the pixel element, the data current flowing through a first path, the reproduction current flowing through a second path, and a voltage of a connecting node between the first path and the second path being substantially constant during the reproduction stage and the programming stage.

17. A driving method for display device that includes a pixel driving circuit having a pixel element, the method comprising:

a programming stage during which a data current for programming is supplied to the pixel driver circuit; and a reproduction stage during which a reproduction current corresponding to the data current is supplied to the pixel element, the data current flowing through a first path, the reproduction current flowing through a second path, and during the reproduction stage, reproducing a voltage at a connecting node between the first path and the second path, the voltage being stored as a voltage of the connecting node during the programming stage.

18. The driving method according to claim 16, the pixel element being an organic electroluminescent element.

* * * * *